US012698146B2

(12) United States Patent
Dohla et al.

(10) Patent No.: US 12,698,146 B2
(45) Date of Patent: Aug. 4, 2026

(54) DISPENSING BOX COMPRISING A STACK OF SHEET PRODUCTS

(71) Applicant: Essity Hygiene and Health Aktiebolag, Gothenburg (SE)

(72) Inventors: Martin Dohla, Ismaning (DE); Vladimir Pisa, Rudnik (CZ)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 16/493,501

(22) PCT Filed: Apr. 3, 2017

(86) PCT No.: PCT/EP2017/057876
§ 371 (c)(1),
(2) Date: Sep. 12, 2019

(87) PCT Pub. No.: WO2018/184655
PCT Pub. Date: Oct. 11, 2018

(65) Prior Publication Data

US 2020/0031566 A1 Jan. 30, 2020

(51) Int. Cl.
*B65D 83/08* (2006.01)

(52) U.S. Cl.
CPC ..... *B65D 83/0805* (2013.01); *B65D 83/0894* (2013.01)

(58) Field of Classification Search
CPC ..... A47K 2010/42; B65D 83/0805; B65D 83/0894
See application file for complete search history.

(56) References Cited

U.S. PATENT DOCUMENTS 3,083,866 A * 4/1963 Strange ..... B65D 5/16 221/302
3,239,097 A * 3/1966 Bates ..... B65D 83/0805 221/48

(Continued)

FOREIGN PATENT DOCUMENTS

AU 2009206167 A1 4/2010
CA 2123565 A1 6/1995

(Continued)

OTHER PUBLICATIONS

European Patent Office, International Search Report and Written Opinion of the International Searching Authority, International Application No. PCT/EP2017/057876, mailed on Dec. 18, 2017 (13 pages).

(Continued)

*Primary Examiner* — Gene O Crawford
*Assistant Examiner* — Kelvin L Randall, Jr.
(74) *Attorney, Agent, or Firm* — CANTOR COLBURN LLP

(57) ABSTRACT

A dispensing box includes a plurality of walls connected to each other, defining an interior volume, and a stack of sheet products received in the interior volume. An opening for removing sheet products is provided in a top wall of the plurality of walls. The dispensing box further includes a cover member. The plurality of walls is made of a first material, the cover member is made of a second material, and the second material is more flexible than the first material. The cover member has a first cut extending in a first direction and having an extension of at least 70% of the extension of the stack of sheet products. The cover member further has at least one second cut extending from the first cut along a second direction intersecting the first direction.

21 Claims, 4 Drawing Sheets

(56) References Cited

U.S. PATENT DOCUMENTS

| | | | | |
|---|---|---|---|---|
| 3,266,666 | A * | 8/1966 | Nelson | A47K 10/423 221/302 |
| 5,219,421 | A * | 6/1993 | Tipping | B65D 83/0805 206/233 |
| 5,316,177 | A * | 5/1994 | Boldt | B65D 83/0805 221/63 |
| 5,415,320 | A * | 5/1995 | North | B65D 83/0894 221/63 |
| 5,613,608 | A | 3/1997 | Tronchetti et al. | |
| 5,871,102 | A | 2/1999 | Lambert | |
| 6,135,842 | A * | 10/2000 | LaFata | A63H 33/28 446/16 |
| 6,318,590 | B1 * | 11/2001 | McMurray-Stivers | B65D 83/0805 224/400 |
| 6,523,690 | B1 * | 2/2003 | Buck | B65D 83/0805 221/63 |
| 6,672,475 | B1 * | 1/2004 | Ho | B65D 83/0847 221/45 |
| 8,602,258 | B2 * | 12/2013 | Long | B65D 83/0894 221/33 |
| 9,538,885 | B2 * | 1/2017 | Cojocaru | B65D 85/672 |
| 9,708,115 | B2 * | 7/2017 | Hirata | A47K 10/32 |
| 10,358,278 | B2 * | 7/2019 | Tan | B65D 33/2541 |
| 10,358,279 | B2 * | 7/2019 | Tan | B65D 33/2508 |
| 2002/0179625 | A1 * | 12/2002 | Huang | B65D 83/0805 221/63 |
| 2002/0179626 | A1 * | 12/2002 | Huang | B65D 83/0805 221/63 |
| 2002/0190074 | A1 * | 12/2002 | Morin | B65D 83/0805 221/63 |
| 2003/0146231 | A1 * | 8/2003 | Sarbo | B65D 83/0805 221/63 |
| 2004/0026440 | A1 * | 2/2004 | Kruchoski | B65D 83/0805 221/33 |
| 2004/0112783 | A1 * | 6/2004 | Mukai | B65B 25/145 206/494 |
| 2004/0124101 | A1 | 7/2004 | Mitchell et al. | |
| 2004/0164087 | A1 * | 8/2004 | Ishida | B65D 83/0805 221/63 |
| 2004/0178211 | A1 * | 9/2004 | Sakamoto | B65D 83/0805 221/63 |
| 2005/0269343 | A1 * | 12/2005 | Gao | B65D 83/0805 221/63 |
| 2006/0151518 | A1 * | 7/2006 | Sarbo | B65D 83/0894 221/63 |
| 2007/0295744 | A1 * | 12/2007 | Sarbo | A47K 10/421 221/63 |
| 2008/0210704 | A1 * | 9/2008 | Lomg | B65D 83/0805 229/125.015 |
| 2010/0243668 | A1 * | 9/2010 | Castela | B65D 83/0805 221/45 |
| 2014/0312048 | A1 * | 10/2014 | Cojocaru | A47K 10/38 221/45 |
| 2016/0185508 | A1 * | 6/2016 | Tan | B65D 83/0805 221/45 |
| 2018/0022534 | A1 * | 1/2018 | McCormick | B65D 83/0805 206/278 |

FOREIGN PATENT DOCUMENTS

| | | | |
|---|---|---|---|
| CN | 1530301 | A | 9/2004 |
| CO | NC20160000701 | A2 | 10/2016 |
| EP | 0953516 | A1 | 11/1999 |
| EP | 1072534 | A1 | 1/2001 |
| EP | 1862396 | A1 | 12/2007 |
| JP | H03148478 | A | 6/1991 |
| JP | 2001278366 | A | 10/2001 |
| JP | 2006213398 | A | 8/2006 |
| JP | 2008162623 | A | 7/2008 |
| JP | 200973559 | A | 4/2009 |
| JP | 2009102078 | A | 5/2009 |
| JP | 3165186 | U | 1/2011 |
| JP | 2013014344 | A | 1/2013 |
| JP | 2013095500 | A | 5/2013 |
| JP | 2014198593 | A | 10/2014 |
| JP | 2015024837 | A | 2/2015 |
| WO | 9934055 | A1 | 7/1999 |

OTHER PUBLICATIONS

Federal Institute of Industrial Property (FIIP), Official Action, Russian Application No. 2019135095/12 (069295), mailed Feb. 10, 2020 (13 pages).

Federal Service for Intellectual Property, Decision To Grant, Russian Application No. 2019135095/11 (069295), mailed May 28, 2020, 17 pages.

Chinese National Intellectual Property Administration, First Office Action in corresponding Chinese Application No. 201780087383.2 dated May 28, 2020, including English translation, 21 pages.

Chinese National Intellectual Property Administration, Office Action, Application No. 201780087383.2, dated Jun. 16, 2021 (15 pages).

Republic of Colombia, Superintendency of Industry and Commerce, Office Action, Application No. NC2019/0010003, mailed Jul. 16, 2021 (9 pages).

Colombian Office Action; Colombian Application No. NC2019/0010003; Date: Jun. 21, 2022; 14 pages.

European Office Action for European Application No. 17 715 455.6; Report Mail Date Nov. 29, 2022 (pp. 1-6).

* cited by examiner

DISPENSING BOX COMPRISING A STACK OF SHEET PRODUCTS

CROSS-REFERENCE TO RELATED APPLICATION

The present application is a national stage entry under 35 U.S.C. § 371 of, and claims priority to, International Application No. PCT/EP2017/057876, filed Apr. 3, 2017, the disclosure of which is hereby incorporated herein by reference in its entirety.

FIELD OF THE INVENTION

The present disclosure relates to a dispensing box comprising a plurality of walls connected to each other, defining an interior volume, and a stack of sheet products, such as tissues, wipes, napkins or the like, received in the interior volume.

BACKGROUND OF THE INVENTION

Sheet products, such as tissues, wipes, napkins and other wiping products in sheet form, are commonly offered as a stack of sheet products received in a dispensing box or a table top container, such as a tissue box. The dispensing box or table top container has an opening through which a user pulls a sheet product in order to remove it from the box or container. In order to facilitate removal of the sheet product from the box or container, adjacent sheet products in the stack may be interfolded with each other. In this way, when removing the top sheet product from the stack and pulling the sheet product completely through the opening in the box or container, the pulled-out sheet product will bring a portion of the next sheet product in the stack out through the opening. Thus, the next sheet product is readily available for gripping and removing from the box or container.

In order to keep the stack of sheet products in the box or container in an uncompromised state, the box or container opening is commonly at least partly closed by a cover member, such as a plastic foil. In this case, sheet products are removed from the box or container through an aperture or a cut in the cover member. If the stack of sheet products is provided in interfolded form, the cover member may further serve to hold the next sheet product in its position, once a sheet product has been pulled completely through the box or container opening. In this position, the sheet product extends out through the box or container opening and is thus readily accessible to the user.

However, when a sheet product is removed from the box or container through the aperture or cut in the cover member, friction is generated between the sheet product and the cover member. Hence, the user has to apply considerable force when pulling out the sheet product through the box or container opening, rendering sheet product removal cumbersome and laborious. In particular, the user may have to hold the dispensing box or table top container with one hand, while pulling out a sheet product with the other hand, in order to prevent the box or container from being lifted up. Since sheet products, such as tissues, wipes, napkins or the like, are frequently used in situations where the user only has one free hand, e.g., in the bathroom or the kitchen, this requirement can cause considerable inconvenience.

Hence, there exists a need for a dispensing box comprising a stack of sheet products which allows for sheet products to be removed in a quick and simple manner.

SUMMARY OF THE INVENTION

Accordingly, it is desired to provide a dispensing box comprising a stack of sheet products which allows for sheet products to be removed in a quick and simple manner. This object can be achieved by a dispensing box with the technical features given in the following.

The dispensing box comprises a plurality of walls connected to each other, defining an interior volume, and a stack of sheet products received or housed in the interior volume. An opening for removing sheet products, i.e., removing sheet products from the interior volume, is provided at least in a top wall of the plurality of walls. The dispensing box further comprises a cover member which is provided so as to at least partly close the opening. The plurality of walls is made of a first material, the cover member is made of a second material, and the second material is more flexible than the first material. The cover member has a first cut extending along a first direction. The first cut has an extension in the first direction which is at least 70% of the extension of the stack of sheet products in the first direction. The cover member further has at least one second cut extending from the first cut along a second direction intersecting the first direction.

The first cut has a first end and a second end. The first cut extends from the first end to the second end. The first direction is the direction from the first end of the first cut towards the second end of the first cut.

The at least one second cut has a first end and a second end. The at least one second cut extends from the first end to the second end. The second direction is the direction from the first end of the at least one second cut towards the second end of the at least one second cut.

The extension of the first cut in the first direction is the distance between the first end of the first cut and the second end of the first cut. The extension of the stack of sheet products in the first direction is the distance between a first end of the stack of sheet products in the first direction and a second end of the stack of sheet products in the first direction.

The extension of the at least one second cut in the second direction is the distance between the first end of the at least one second cut and the second end of the at least one second cut.

The first cut and the at least one second cut extend through the entire thickness of the cover member. The first cut and the at least one second cut thus extend from a top surface of the cover member to a bottom surface of the cover member.

The first cut and the at least one second cut enable the removal of sheet products from the interior volume through the opening which is provided at least in the top wall.

The top wall may be a substantially planar wall. In this case, the first and second directions are parallel to the plane of the top wall.

The extension of the first cut in the first direction is at least 70% of the extension of the stack of sheet products in the first direction. Further, the cover member has at least one second cut extending from the first cut along the second direction intersecting the first direction. The at least one second cut is a friction relieving cut. The at least one second cut thus relieves friction generated when a sheet product is removed from the interior volume through the opening in at least the top wall.

Hence, the dispensing box allows for sheet products to be removed in a quick and simple manner.

The first cut may have an extension in the first direction which is at least 72%, preferably at least 74% and more preferably at least 75% of the extension of the stack of sheet products in the first direction.

The cover member may be a sheet, a film or a foil, for example, a plastic foil.

The cover member may be provided underneath the opening, i.e., underneath the opening in the direction from the top wall towards a bottom wall of the plurality of walls. The cover member may be provided above the opening, i.e., above the opening in the direction from the top wall towards the bottom wall of the plurality of walls.

The cover member may be provided so as to extend beyond the opening in one, some or all of the directions perpendicular to the direction from the top wall towards the bottom wall.

The plurality of walls may comprise the top wall, the bottom wall, two opposing side walls and two opposing end walls. In this case, the top wall is connected to the bottom wall through the two side walls and the two end walls.

The bottom wall may be a substantially planar wall.

The sheet products may be sanitary sheet products, such as tissues, e.g., facial tissues, wipes, e.g., dry wipes or wet wipes, napkins or the like.

A tissue paper is defined as a soft absorbent paper having a basis weight below 65 g/m$^2$ and typically between 10 and 50 g/m$^2$. Its density is typically below 0.60 g/cm$^3$, preferably below 0.30 g/cm$^3$ and more preferably between 0.08 and 0.20 g/cm$^3$. Moist tissue paper webs are usually dried against one or more heated rolls. A method which is commonly used for tissue paper is the so-called Yankee drying. At Yankee drying, the moist paper web is pressed against a steam-heated Yankee cylinder which can have a very large diameter. The paper web is usually creped against the Yankee cylinder.

Another drying method is so called through-air-drying (TAD). In this method, the paper is dried by means of hot air blown through the moist paper web, often without a preceding wet pressing. In connection with the TAD drying, the patterned structure of the drying fabric is transferred to the paper web. This structure is essentially maintained also in wet condition of the paper, since it has been imparted to the wet paper web.

In International Patent Application No. PCT/SE98/02461 there is disclosed a method for producing an impulse dried paper, especially tissue paper, having a three-dimensional pattern, said paper having high bulk and softness. Impulse drying shortly involves that the moist paper web is passed through the press nip between a press roll or press shoe and a heated roll, which is heated to such a high temperature that a quick and strong steam generation occurs in the interface between the moist paper web and the heated roll. The three-dimensional embossment pattern is accomplished by means of a pattern provided on the heated roll. The counter means, for example a press felt, against which the paper is pressed in connection with the simultaneous impulse drying and shaping, has a non-rigid surface.

The present disclosure refers to all types of tissue paper. The tissue paper may be creped or non-creped. The creping may take place in wet or dry condition. It may further be foreshortened by any other methods, such as so-called rush transfer between wires.

The fibres contained in the tissue paper may be mainly pulp fibres from chemical pulp, mechanical pulp, thermo-mechanical pulp, chemo-mechanical pulp and/or chemo-thermo-mechanical pulp (CTMP). The fibres may also be recycled fibres. The tissue paper may also contain other types of fibres enhancing, e.g., strength, absorption or softness of the paper. These fibres may be made from regenerated cellulose or synthetic material, such as polyolefin, polyesters, polyamides etc.

The tissue paper coming out from the tissue machine as a single-ply paper sheet may be converted to the final tissue product in many ways, for example embossed, laminated to a multi-ply product, rolled or folded. A laminated multi-ply tissue product comprises at least two tissue plies, which are often joined by either adhesive or mechanically. The adhesive may be applied all over the paper or just in regions, for example, dots or lines, or only along the edges of the product. The mechanical methods are mainly embossing either over the entire area of the plies or only along the edges, so called edge embossing. In the final product, the plies are mostly easily detectable and can often be separated from each other as single plies.

The tissue paper coming out from the tissue paper machine may comprise one or more layers. In the case of more than one layer, this is accomplished either in a multi-layered headbox, by forming a new layer on top of an already formed layer or by couching together already formed layers. These layers cannot or only with considerable difficulty be separated from each other and are joined mainly by hydrogen bonds. The different layers may be identical or may have different properties regarding, for example, fibre composition and chemical composition.

The first cut has a first end in the first direction and a second end in the first direction. The at least one second cut may extend from the first end or the second end of the first cut. In this case, the first end of the at least one second cut coincides with the first end or the second end of the first cut.

The at least one second cut may extend from one of the first and second ends of the first cut, and the at least one second cut may extend in a direction substantially perpendicular to the first direction or in a direction away from the other of the first and second ends of the first cut. The second direction may thus intersect the first direction at an angle of 90° or less.

This angle is determined between a virtual straight line extending from the first end of the at least one second cut to the second end of the at least one second cut and a virtual straight line extending from the one of the first and second ends of the first cut away from the other of the first and second ends of the first cut in the first direction.

The angle at which the second direction of the at least one second cut intersects the first direction may be 10° or more, preferably 20° or more, more preferably 30° or more and yet more preferably 40° or more.

By arranging the at least one second cut so as to extend in a direction substantially perpendicular to the first direction or in a direction away from the other of the first and second ends of the first cut, it can be ensured that the sheet products can be removed from the interior volume in a particularly quick and simple manner.

The at least one second cut may extend from the first cut at a position between the first and second ends of the first cut.

The cover member may have a plurality of second cuts, each second cut extending from the first cut along a respective second direction intersecting the first direction. Some or all of the second directions may be different from each other. Some or all of the second directions may be identical with each other.

One, some or all of the second directions may intersect the first direction at an angle of 90° or less. One, some or all of the second directions may intersect the first direction at an angle of 10° or more, preferably 20° or more preferably 30° or more and yet more preferably 40° or more.

The cover member may have at least two second cuts.

The at least two second cuts may extend from the first cut towards opposite sides of the opening. The at least two second cuts thus may extend along opposite directions relative to the first cut.

The at least two second cuts may extend from the first end or the second end of the first cut. One of the at least two second cuts may extend from the first end of the first cut and the other of the at least two second cuts may extend from the second end of the first cut.

At least one of the at least two second cuts may extend from the first cut at a position between the first and second ends of the first cut. One of the at least two second cuts may extend from the first end or the second end of the first cut and the other of the at least two second cuts may extend from the first cut at a position between the first and second ends of the first cut. The at least two second cuts may extend from the first cut at the same position between the first and second ends of the first cut or at different positions between the first and second ends of the first cut.

The at least two second cuts may be arranged symmetrically to each other relative to the first direction.

The cover member may have at least three second cuts.

Two of the at least three second cuts may extend from the first cut towards opposite sides of the opening.

At least two of the at least three second cuts may extend from the first end or the second end of the first cut.

At least one of the at least three second cuts may extend from the first cut at a position between the first and second ends of the first cut.

One of the at least three second cuts may extend from the first end of the first cut, one of the at least three second cuts may extend from the second end of the first cut, and one of the at least three second cuts may extend from the first cut at a position between the first and second ends of the first cut.

The at least three second cuts may extend from the first cut at the same position between the first and second ends of the first cut or at different positions between the first and second ends of the first cut.

Two of the at least three second cuts may be arranged symmetrically to each other relative to the first direction.

The cover member may have four second cuts.

Two of the four second cuts may extend from the first end of the first cut and the other two of the four second cuts may extend from the second end of the first cut. In this way, removal of the sheet products from the interior volume can be facilitated in a particularly efficient manner.

The two of the second cuts extending from the first end of the first cut may extend in directions substantially perpendicular to the first direction or in directions away from the second end of the first cut. The two of the second cuts extending from the first end of the first cut may extend towards opposite sides of the opening.

The two of the second cuts extending from the first end of the first cut may be arranged symmetrically to each other relative to the first direction.

The two of the second cuts extending from the second end of the first cut may extend in directions substantially perpendicular to the first direction or in directions away from the first end of the first cut. The two of the second cuts extending from the second end of the first cut may extend towards opposite sides of the opening.

The two of the second cuts extending from the second end of the first cut may be arranged symmetrically to each other relative to the first direction.

The four second cuts may be arranged symmetrically to each other with respect to the center of the opening.

The at least one second cut may extend substantially to an edge of the opening. The at least one second cut may have an extension in the second direction which is at least 80%, preferably at least 90% and more preferably at least 95% of the distance between the position at which the at least one second cut extends from the first cut and the edge of the opening in the second direction.

The cover member may have a plurality of second cuts, each second cut extending from the first cut along a respective second direction intersecting the first direction. One, some or all of the plurality of second cuts may extend substantially to a respective edge of the opening. One, some or all of the second cuts may have an extension in the second direction which is at least 80%, preferably at least 90% and more preferably at least 95% of the distance between the position at which the second cut extends from the first cut and the edge of the opening in the second direction.

The second direction may be substantially perpendicular to the first direction.

The opening which is provided at least in the top wall of the plurality of walls may have an extension in the first direction which is at least 75%, preferably at least 80% and more preferably at least 90% of the extension of the stack of sheet products in the first direction.

The opening may have an extension in the direction perpendicular to the first direction which is at least 20%, preferably at least 30%, more preferably at least 40% and yet more preferably at least 50% of the extension of the stack of sheet products in the direction perpendicular to the first direction.

The opening may have a polygonal shape, such as a square shape, a rectangular shape, a hexagonal shape etc., or a round shape, such as a circular shape, an oval shape, an elliptical shape etc. For example, the opening may have the shape of an elongated polygon, such as an elongated hexagon, e.g., with one or more rounded edges and/or corners.

The opening may be an elongate opening. The first direction may be substantially parallel to the longitudinal direction of the opening.

The width of the opening in the direction perpendicular to the longitudinal direction of the opening may be at least 15%, preferably at least 20%, more preferably at least 25% and yet more preferably at least 30% of the length of the opening in the longitudinal direction of the opening.

The maximum width of the opening in the direction perpendicular to the longitudinal direction of the opening may be at least 15%, preferably at least 20%, more preferably at least 25% and yet more preferably at least 30% of the length of the opening in the longitudinal direction of the opening.

The cover member may further have at least one third cut extending from the at least one second cut along a third direction intersecting the second direction.

The at least one third cut has a first end and a second end. The at least one third cut extends from the first end to the second end. The third direction is the direction from the first end of the at least one third cut towards the second end of the at least one third cut.

The extension of the at least one third cut in the third direction is the distance between the first end of the at least one third cut and the second end of the at least one third cut.

The at least one third cut extends through the entire thickness of the cover member.

The at least one third cut may extend from an end of the at least one second cut in the second direction. The at least one third cut may extend from the second end of the at least one second cut in the second direction, i.e., the end of the at least one second cut which is not arranged at the first cut.

The at least one third cut may have a straight shape, a curved shape, a zigzag shape or an undulating shape.

The at least one third cut may at least partly extend along an edge of the opening. The entire at least one third cut may extend along an edge of the opening.

The cover member may have a plurality of second cuts and a plurality of third cuts. Each third cut may extend from an end of a respective second cut. Each third cut may extend from the second end of the respective second cut.

Each of the third cuts extends from a respective second cut along a respective third direction intersecting the respective second direction. Some or all of the third directions may be different from each other. Some or all of the third directions may be identical with each other.

The cover member may have at least two second cuts and at least two third cuts, and each third cut may extend from an end of a respective second cut. Each third cut may extend from the second end of the respective second cut.

The at least two second cuts and/or the at least two third cuts may be arranged symmetrically to each other relative to the first direction.

The cover member may have at least three second cuts and at least three third cuts. Each third cut may extend from an end of a respective second cut. Each third cut may extend from the second end of the respective second cut.

Two of the at least three second cuts and/or two of the at least three third cuts may be arranged symmetrically to each other relative to the first direction.

The cover member may have four second cuts and four third cuts. Each third cut may extend from an end of a respective second cut. Each third cut may extend from the second end of the respective second cut.

Two of the four second cuts and/or two of the four third cuts may be arranged symmetrically to the other two of the four second cuts and/or the other two of the four third cuts, respectively, relative to the first direction.

The four second cuts and/or the four third cuts may be arranged symmetrically to each other with respect to the center of the opening.

The at least one third cut may have an extension in the third direction which is at least 5%, preferably at least 10%, more preferably at least 15% and yet more preferably at least 20% of the extension of the at least one second cut in the second direction.

The at least one third cut further reduces the friction generated when removing a sheet product from the interior volume, thus allowing for a particularly quick and simple removal process.

The at least one second cut may be arranged so that it extends from the first cut at a first end of the second cut. The cover member may have an opening or an aperture at the second end of the at least one second cut. Such a hole or aperture further reduces the friction generated upon removal of a sheet product from the interior volume.

The first cut may have an extension in the first direction which is not more than 95%, preferably not more than 92% and more preferably not more than 90% of the extension of the stack of sheet products in the first direction. In this way, after removal of a sheet product from the interior volume, the next sheet product can be particularly reliably held in its position, in particular, in a substantially upright position, by the cover member, so as to make the sheet product readily accessible to a user.

The plurality of walls may have two opposing side walls which are connected to each other by the top wall. The opening may extend to the side walls so as to be present also in the side walls. In this way, removal of the sheet products from the interior volume can be further facilitated.

The first cut may extend to one or both of the side walls.

The first direction is the direction from the first end of the first cut in the top wall towards the second end of the first cut in the top wall. The extension of the first cut in the first direction is the distance between the first end in the top wall and the second end in the top wall.

At least one second cut and/or at least one third cut of the cover member may be provided in one or both of the side walls.

The plurality of walls may substantially have a rectangular prism shape, a cubic shape or a round shape, such as an ellipsoidal shape or the like. In particular, the plurality of walls may have a rectangular prism shape or a cubic shape in which one, some or all of the edges and/or the corners are rounded.

Adjacent sheet products in the stack of sheet products may be interfolded with each other. In this way, it can be reliably ensured that, upon removal of a sheet product from the interior volume, a portion of the next sheet product in the stack is brought out through the opening and held in its position, in particular, a substantially upright position, by the cover member. Thus, the next sheet product can be made readily available for gripping and removing by the user.

Adjacent sheet products in the stack of sheet products may not be interfolded with each other. For example, adjacent sheet products may be individually folded but not interfolded with each other. Also, the sheet products may be provided in the stack in unfolded form, e.g., so as to be entirely flat.

Adjacent sheet products in the stack of sheet products may be provided with perforations at least partly penetrating the sheet products and providing a loose connection therebetween. Also, in this way, it can be achieved that, upon removal of a sheet product from the interior volume, a portion of the next sheet product in the stack is brought out through the opening and held in its position, in particular, a substantially upright position, by the cover member. Alternatively or additionally, for this purpose, the sheet products in the stack of sheet products may be chosen so as to have a sufficient degree of surface roughness.

The first cut may have a straight shape, a curved shape, a zigzag shape or an undulating shape.

The at least one second cut may have a straight shape, a curved shape, a zigzag shape or an undulating shape. A curved shape of the at least one second cut can help to position the next sheet product when removing a sheet product from the interior volume, so as to make the next sheet product readily available for gripping and removing by the user.

The cover member may have a plurality of second cuts, each second cut extending from the first cut along a respective second direction intersecting the first direction. One, some or all of the second cuts may have a straight shape, a curved shape, a zigzag shape or an undulating shape. Some or all of the second cuts may have the same shape. Some or all of the second cuts may have different shapes from each other.

The cover member may have a plurality of third cuts, each third cut extending from a respective second cut along a respective third direction intersecting the second direction. One, some or all of the third cuts may have a straight shape, a curved shape, a zigzag shape or an undulating shape. Some or all of the third cuts may have the same shape. Some or all of the third cuts may have different shapes from each other.

The first cut may substantially extend along a center of the opening. The first cut may be arranged along the center of the opening in the direction perpendicular to the first direction.

The first cut may be arranged so that a distance between the first end of the first cut and the adjacent edge of the opening in the first direction is substantially the same as a distance between the second end of the first cut and the adjacent edge of the opening in the first direction.

The plurality of walls may be made of cardboard, plastic, metal, ceramic or the like. Particularly preferably, the plurality of walls is made of cardboard.

The cover member may be made of a plastic material, such as a polymer material, paper, metal or the like. Particularly preferably, the cover member is made of a polymer material, such as polyethylene (PE), polypropylene (PP), polyvinyl chloride (PVC), polyester or the like.

The stack of sheet products may be received in the interior volume in a substantially uncompressed state. In this way, removal of the sheet products from the interior volume can be further facilitated.

The height of the substantially uncompressed stack of sheet products may be 95% or less, preferably 90% or less and more preferably 85% or less of the height of the interior volume between the inner surface of the top wall and the inner surface of the bottom wall.

The cover member may have a thickness in the range of 60 μm to 80 μm, preferably 65 μm to 78 μm and more preferably 70 μm to 75 μm.

Particularly preferably, the cover member is made of polyethylene and has a thickness in the range of 70 μm to 75 μm.

In this way, it can be particularly reliably ensured that, upon removal of a sheet product from the interior volume, the next sheet product is held in its position by the cover member, while allowing for a quick and simple sheet product removal.

BRIEF DESCRIPTION OF THE DRAWINGS

For a better understanding of the present disclosure and to show how the same may be carried into effect, reference will now be made, by way of example only, to the accompanying drawings, in which.

DETAILED DESCRIPTION OF THE INVENTION

Particular embodiments of the present disclosure will now be described with reference to the accompanying drawings.

Figure 1:
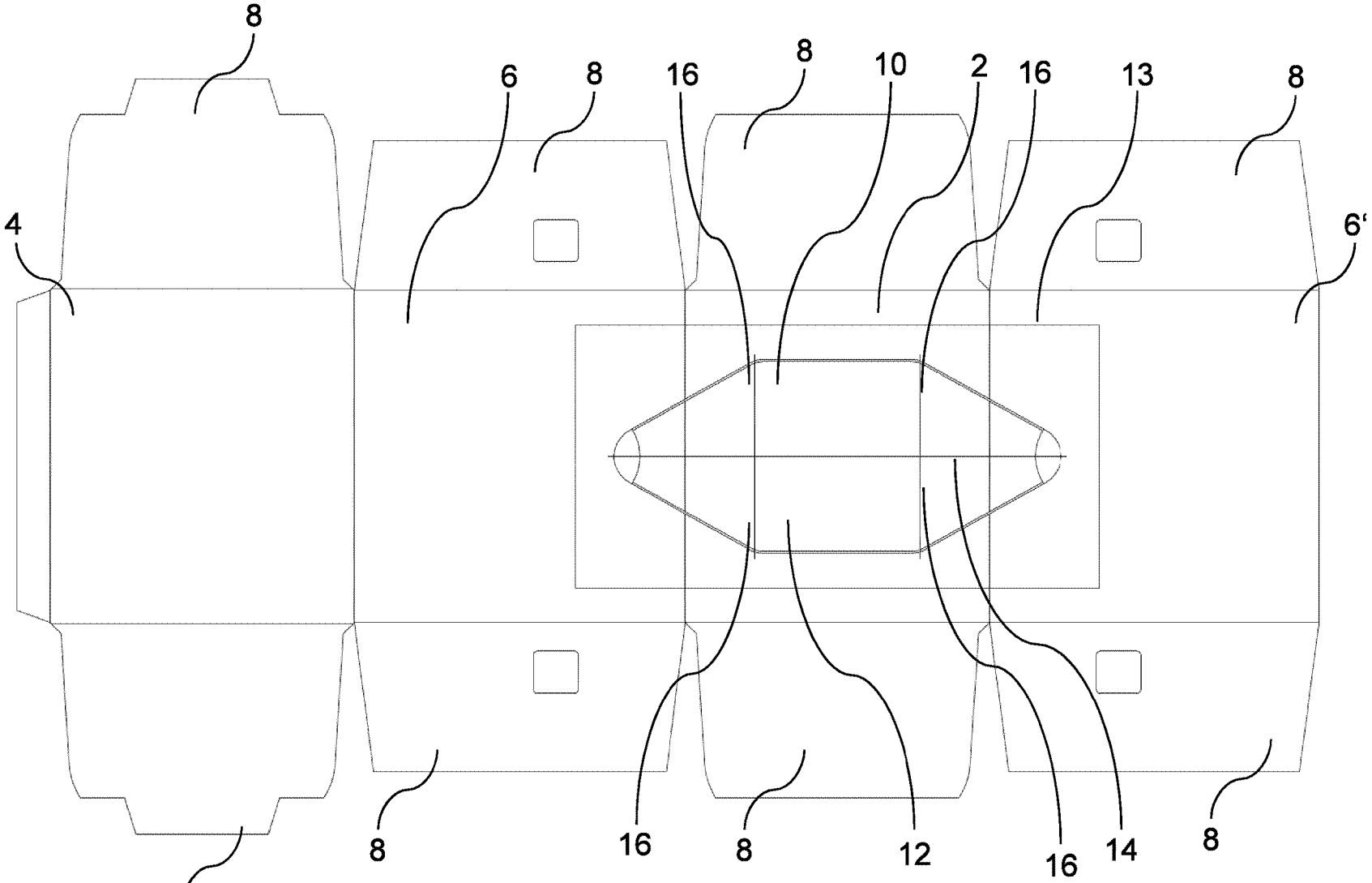
FIG. 1 shows a schematic top view of a dispensing box according to a first embodiment of the present disclosure in an unfolded state thereof.

FIG. 1 shows a schematic top view of a dispensing box according to a first embodiment of the present disclosure in an unfolded state thereof, i.e., a top view of a blank that can be folded into the dispensing box of the first embodiment.

The dispensing box comprises a plurality of walls connected to each other, defining an interior volume in the folded, i.e., fully assembled, state of the box. In the folded state of the dispensing box, the box substantially has a cubic shape.

The plurality of walls comprises a top wall 2, a bottom wall 4, two opposing side walls 6, 6' and eight end flaps 8 forming two opposing end walls in the folded state of the dispensing box. The top wall 2 and the bottom wall 4 are substantially planar walls. Also, the two opposing side walls 6, 6' and the two opposing end walls are substantially planar walls. The plurality of walls is made of cardboard.

A stack of sheet products (not shown), such as a stack of tissues, wipes, napkins or the like, is received in the interior volume defined by the plurality of walls in the folded state of the box.

An opening 10 for removing sheet products is provided in the top wall 2. As is shown in FIG. 1, the opening 10 is an elongate opening that extends to the side walls 6, 6' so as to be present also in the side walls 6, 6'. Specifically, in the unfolded, i.e., laid out flat, state of the box, the opening 10 has the shape of an elongated hexagon with rounded corners at the ends thereof in the longitudinal direction. The maximum width of the opening 10 in the direction perpendicular to the longitudinal direction thereof is approximately half of the length of the opening 10 in the longitudinal direction thereof.

The dispensing box further comprises a cover member 12 which is provided so as to close the opening 10. The cover member 12 is provided underneath the opening 10, i.e., underneath the opening 10 in the direction from the top wall 2 towards the bottom wall 4 in the folded state of the box. Alternatively, the cover member 12 may be provided above the opening 10.

The cover member 12 is provided so as to extend beyond the opening 10 in all directions perpendicular to the direction from the top wall 2 towards the bottom wall 4, as is indicated by a rectangle 13 surrounding the opening 10 in FIG. 1.

The cover member 12 is a plastic foil, for example, made of polyethylene, and has a thickness in the range of 70 μm to 75 μm. The plastic material of the cover member 12 is more flexible than the cardboard material of the plurality of walls.

The cover member 12 has a first cut 14 extending along a first direction, namely the longitudinal direction of the opening 10, as is shown in FIG. 1. The first direction is the direction from the first end of the first cut 14 in the top wall 2 towards the second end of the first cut 14 in the top wall 2. Thus, the first direction is the direction from a position at which the first cut 14 intersects a first side edge of the top wall 2 towards a position at which the first cut 14 intersects a second, opposite side edge of the top wall 2 (see FIG. 1).

The first cut 14 may be provided in the cover member 12, for example, by using a cutting blade or the like. The first cut 14 may be provided in the cover member 12, for example, by using a cutting blade or the like, before or after the cover member 12 is secured to the remainder of the box. The first cut 14 extends to both of the side walls 6, 6'.

As is shown in FIG. 1, the first cut 14 extends along the entire length of the opening 10 in the longitudinal direction of the opening 10. The extension of the first cut 14 in the first direction is the distance between the first end thereof in the top wall 2 and the second end thereof in the top wall 2. Thus, in the embodiment shown in FIG. 1, the first cut 14 provided in the top wall 2 has an extension in the first direction which is 100% of the extension of the stack of sheet products in the first direction.

In some embodiments, the extension of the first cut 14 in the first direction may be more than 100% of the extension of the stack of sheet products in the first direction, for example, if the stack of sheet products extends in the first direction along only part of the length of the interior volume in the first direction.

In some embodiments, the extension of the first cut 14 in the first direction may be less than 100% of the extension of the stack of sheet products in the first direction, for example, at least 70%, at least 72%, at least 74% or at least 75% of the extension of the stack of sheet products in the first direction, as has been detailed above.

The first cut 14 has a straight shape and substantially extends along a center of the opening 10.

The stack of sheet products may be received in the interior volume in a folded state, e.g., in the form of a C-fold arrangement in which the stack has been folded around the first direction. Adjacent sheet products in the stack of sheet products are interfolded with each other.

Further, the cover member 12 has four second cuts 16, each second cut 16 extending from the first cut 14 along a respective second direction intersecting the first direction. Specifically, the second directions are substantially perpendicular to the first direction. Thus, the second directions intersect the first direction at an angle of 90°.

The second cuts 16 may be provided in the cover member 12, for example, by using a cutting blade or the like. The second cuts 16 may be provided in the cover member 12, for example, by using a cutting blade or the like, before or after the cover member 12 is secured to the remainder of the box.

Two of the second cuts 16 extend from the first cut 14 at a first position between the first and second ends of the first cut 14 (on the left-hand side in FIG. 1) and two of the second cuts 16 extend from the first cut 14 at a second position between the first and second ends of the first cut 14 (on the right-hand side in FIG. 1). Each of the second cuts 16 extends to the edge of the opening 10.

The two second cuts 16 extending from the first cut 14 at the first position extend towards opposite sides of the opening 10. Also, the two second cuts 16 extending from the first cut 14 at the second position extend towards opposite sides of the opening 10 (see FIG. 1). Each of the second cuts 16 has a straight shape.

As is shown in FIG. 1, the second cuts 16 extend along the width direction of the opening 10 in positions where the opening 10 has its maximum width. Specifically, the second cuts 16 extend to corners of the elongated hexagonal opening 10. The four second cuts 16 are arranged symmetrically to each other with respect to the center of the opening 10.

The first cut 14 and the second cuts 16 extend through the entire thickness of the cover member 12.

The first cut 14 and the four second cuts 16 enable the removal of sheet products from the interior volume through the opening 10 in a quick and simple manner. In particular, the four second cuts 16 are friction relieving cuts which relieve the friction generated when a sheet product is removed from the interior volume through the opening 10.

The cover member 12 further holds the next sheet product in a substantially upright position once a sheet product has been pulled completely through the opening 10. In this position, the sheet product extends out through the opening 10 and is thus readily accessible to the user.

Figure 2:
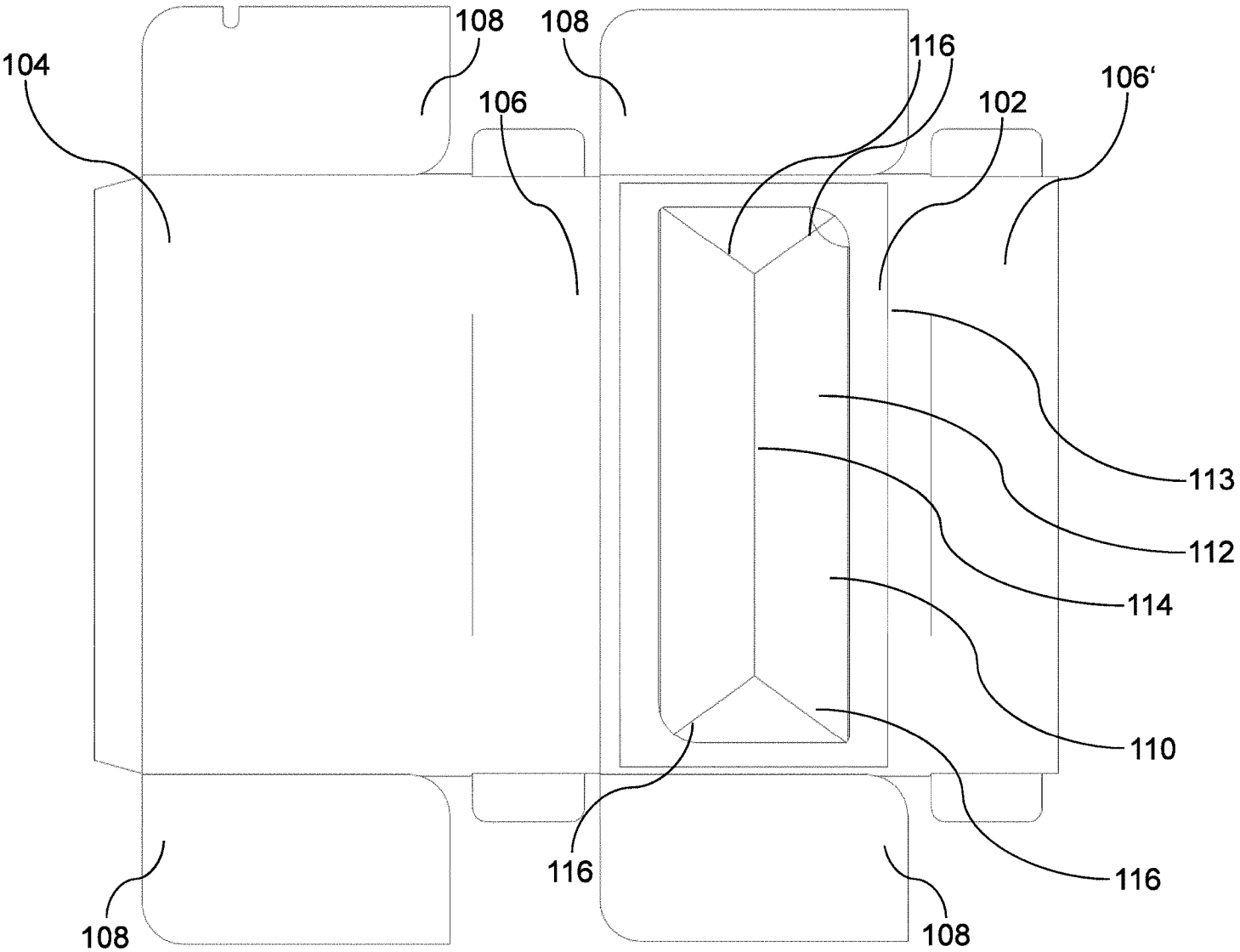
FIG. 2 shows a schematic top view of a dispensing box according to a second embodiment of the present disclosure in an unfolded state thereof.

FIG. 2 shows a schematic top view of a dispensing box according to a second embodiment of the present disclosure in an unfolded state thereof.

The dispensing box of the second embodiment substantially differs from the dispensing box of the first embodiment in the shape of the box, the shape and the arrangement of the opening, and the arrangement of the first and second cuts.

The dispensing box of the second embodiment has a planar top wall 102, a planar bottom wall 104, two opposing planar side walls 106, 106' and four end flaps 108 which form two opposing planar end walls in the folded, i.e., fully assembled, state of the box. However, in contrast to the box of the first embodiment, the box of the second embodiment has an elongate rectangular prism shape in its assembled state.

A stack of sheet products (not shown) is received in the interior volume formed by the top wall 102, the bottom wall 104, the two side walls 106, 106' and the two end walls. The stack of sheet products is provided in the interior volume in an unfolded and uncompressed state. Adjacent sheet products in the stack of sheet products are interfolded with each other.

An opening 110 for removing sheet products is provided only in the top wall 102 (see FIG. 2). The opening 110 has a substantially rectangular shape with two opposing rounded corners. The longitudinal direction of the opening 110 is parallel to the longitudinal direction of the top wall 102, i.e., the longitudinal direction of the elongated rectangular prism shaped dispensing box. The width of the opening 110 in the direction perpendicular to the longitudinal direction thereof is approximately a third of the length of the opening 110 in the longitudinal direction thereof.

Further, the box comprises a cover member 112 which is provided so as to close the opening 110. The plurality of walls and the cover member 112 of the box of the second embodiment are made of the same materials as the plurality of walls and the cover member 12, respectively, of the box of the first embodiment.

The cover member 112 is provided underneath the opening 110. Alternatively, the cover member 112 may be provided above the opening 110. The cover member 112 is provided so as to extend beyond the opening 110 in all directions perpendicular to the direction from the top wall 102 towards the bottom wall 104, as is indicated by a rectangle 113 surrounding the opening 110 in FIG. 2.

The cover member 112 has a first cut 114 extending along a first direction which is parallel to the longitudinal direction of the elongate opening 110 (see FIG. 2). The first cut 114 has an extension in the first direction which is approximately 70% of the extension of the stack of sheet products in the first direction. The first cut 114 has a straight shape and substantially extends along a center of the opening 110.

The first cut 114 may be provided in the cover member 112, for example, by using a cutting blade or the like. The first cut 114 may be provided in the cover member 112, for example, by using a cutting blade or the like, before or after the cover member 112 is secured to the remainder of the box.

Moreover, the cover member 112 has four second cuts 116, each second cut 116 extending from the first cut 114 along a respective second direction intersecting the first direction. The first cut 114 has a first end in the first direction (lower end in FIG. 2) and a second end in the first direction (upper end in FIG. 2). Two of the second cuts 116 extend from the first end of the first cut 114 and two of the second cuts 116 extend from the second end of the first cut 114.

The second cuts 116 may be provided in the cover member 112, for example, by using a cutting blade or the like. The second cuts 116 may be provided in the cover member 112, for example, by using a cutting blade or the like, before or after the cover member 112 is secured to the remainder of the box.

The two of the second cuts 116 extending from the first end of the first cut 114 extend in directions away from the second end of the first cut 114 towards opposite sides of the opening 110. The two of the second cuts 116 extending from the second end of the first cut 114 extend in directions away from the first end of the first cut 114 towards opposite sides of the opening 110.

Specifically, as is shown in FIG. 2, the second directions of the second cuts 116 intersect the first direction at an angle of approximately 45°. For each second cut 116, the intersection angle is determined between a virtual straight line extending from the first end of the second cut 116, i.e., the end thereof which coincides with the first end or the second end of the first cut 114, respectively, to the second end of the second cut 116 and a virtual straight line extending from the one of the first and second ends of the first cut 114 from which the respective second cut 116 extends away from the other of the first and second ends of the first cut 114 in the first direction.

Each of the second cuts 116 extends to a respective edge of the opening 110, i.e., to a respective corner of the substantially rectangular opening 110. The four second cuts 116 each have a straight shape.

The first cut 114 and the four second cuts 116 allow for sheet products to be removed in a quick and simple manner. In particular, the four second cuts 116 are friction relieving cuts which relieve the friction generated when a sheet product is removed from the interior volume through the opening 110.

The cover member 112 further holds the next sheet product in a substantially upright position once a sheet product has been pulled completely through the opening 110. In this position, the sheet product extends out through the opening 110 and is thus readily accessible to the user.

Figure 3:
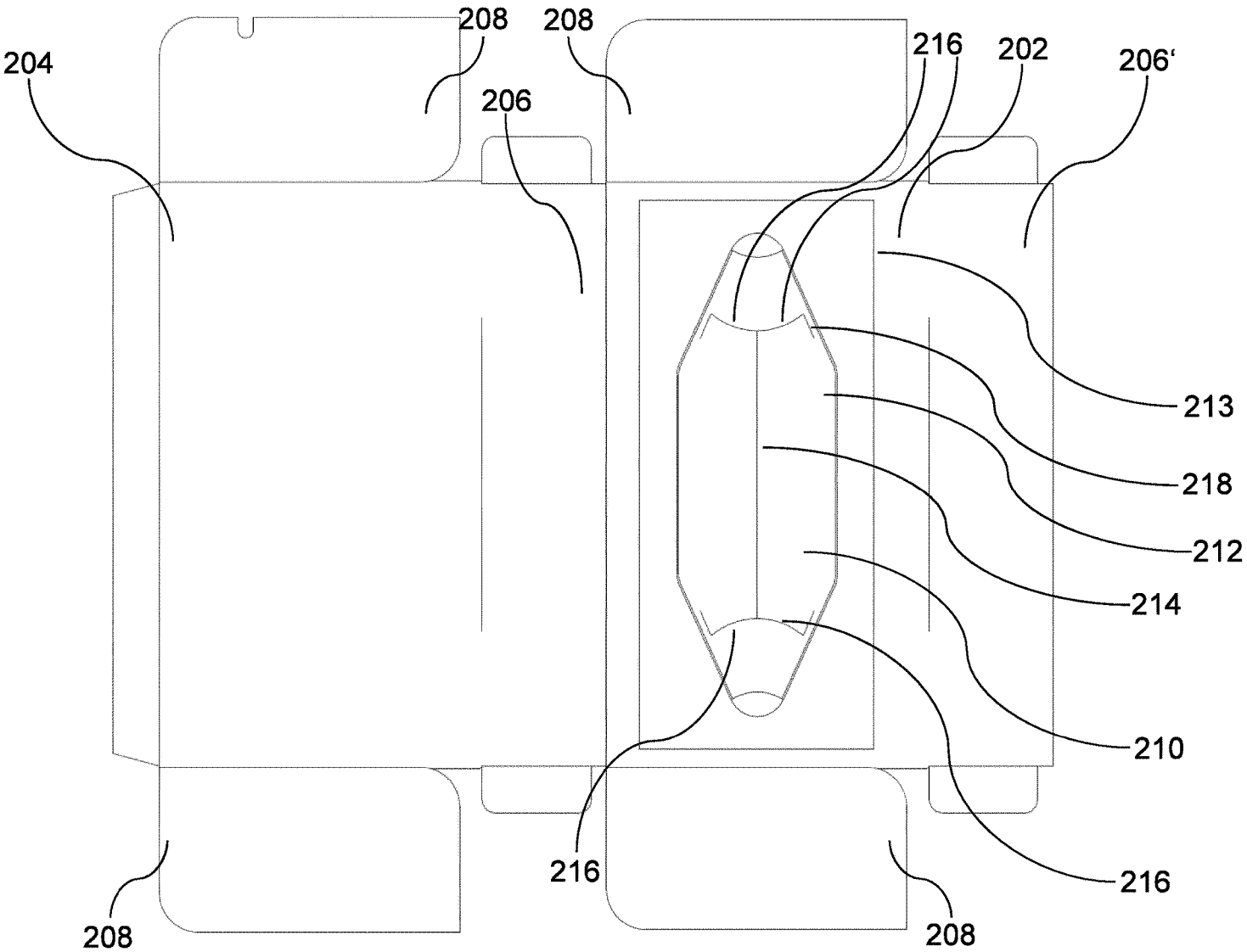
FIG. 3 shows a schematic top view of a dispensing box according to a third embodiment of the present disclosure in an unfolded state thereof.

FIG. 3 shows a schematic top view of a dispensing box according to a third embodiment of the present disclosure in an unfolded state thereof.

The dispensing box of the third embodiment differs from the dispensing box of the second embodiment only in the shape of the opening and in the number, the shape and the arrangement of the cuts.

The arrangement of the plurality of walls and the shape of the folded, i.e., fully assembled, box are the same for the second and third embodiments. Specifically, the box of the third embodiment has a planar top wall 202, a planar bottom wall 204, two opposing planar side walls 206, 206' and four end flaps 208 which form two opposing planar end walls in the folded state of the box. Also, the arrangement of the stack of sheet products (not shown) in the interior volume defined by the plurality of walls is the same for the boxes of the second and third embodiments.

The top wall 202 has an opening 210 for removing sheet products from the interior volume. The opening 210 is only provided in the top wall 202 and has the shape of an elongated hexagon with rounded corners at the two ends thereof in the longitudinal direction. The shape of the opening 210 is substantially the same as the shape of the opening 10 of the box of the first embodiment in the unfolded state of the latter (see FIGS. 1 and 3).

The longitudinal direction of the opening 210 is parallel to the longitudinal direction of the top wall 202, i.e., the longitudinal direction of the assembled dispensing box.

The opening 210 is closed by a cover member 212. The materials of the pluralities of walls and the cover member 212 of the box of the third embodiment are the same as the materials of the plurality of walls and the cover member 112, respectively, of the second embodiment.

The cover member 212 is provided underneath the opening 210. Alternatively, the cover member 212 may be provided above the opening 210. The cover member 212 is provided so as to extend beyond the opening 210 in all directions perpendicular to the direction from the top wall 202 towards the bottom wall 204, as is indicated by a rectangle 213 surrounding the opening 210 in FIG. 3.

The cover member 212 has a first cut 214 extending along a first direction, i.e., the longitudinal direction of the opening 210. The first cut 214 has an extension in the first direction which is approximately 70% of the extension of the stack of sheet products in the first direction. The first cut 214 has a straight shape and substantially extends along a center of the opening 210.

The first cut 214 may be provided in the cover member 212, for example, by using a cutting blade or the like. The first cut 214 may be provided in the cover member 212, for example, by using a cutting blade or the like, before or after the cover member 212 is secured to the remainder of the box.

Moreover, the cover member 212 has four second cuts 216, each second cut 216 extending from the first cut 214 along a respective second direction intersecting the first direction.

The second cuts 216 may be provided in the cover member 212, for example, by using a cutting blade or the like. The second cuts 216 may be provided in the cover member 212, for example, by using a cutting blade or the like, before or after the cover member 212 is secured to the remainder of the box.

The arrangement of the second cuts 216 is similar to the arrangement of the second cuts 116 of the box according to the second embodiment in that two of the second cuts 216 extending from a first end of the first cut 214 extend in directions away from a second end of the first cut 214 towards opposite sides of the opening 210, and two of the second cuts 216 extending from the second end of the first cut 214 extend in directions away from the first end of the first cut 214 towards opposite sides of the opening 210.

However, in contrast to the second cuts 116, the second cuts 216 each have a curved shape rather than a straight shape. As is shown in FIG. 3, for each of the second cuts 216, the center of curvature is at a position which is located outwards, i.e., towards the respective edge of the opening 210 or the respective edge of the top wall 202, from the end of the first cut 214 from which the respective second cut 216 extends.

Each second cut 216 has a first end, coinciding with the first end or the second end of the first cut 214, respectively, and a second end. The second direction is the direction from the first end of the respective second cut 216 towards the second end of the respective second cut 216. Each of the second directions of the second cuts 216 intersects the first direction at an angle of approximately 80° (see FIG. 3).

Each of the second cuts 216 extends to a position close to a respective edge of the opening 210. Specifically, each second cut 216 has an extension in the second direction which is approximately 90% of the distance between the position at which the respective second cut 216 extends from the first cut 214 and the edge of the opening 210 in the respective second direction.

The cover member 212 further has four third cuts 218, only one of which is denoted with a reference sign in FIG.

3 for better presentability. Each third cut 218 has a straight shape and extends from the second end of a respective second cut 216. Each third cut 218 extends from the respective second cut 216 along a third direction intersecting the second direction (see FIG. 3). Each third cut 218 extends through the entire thickness of the cover member 212.

The third cuts 218 may be provided in the cover member 212, for example, by using a cutting blade or the like. The third cuts 218 may be provided in the cover member 212, for example, by using a cutting blade or the like, before or after the cover member 212 is secured to the remainder of the box.

Each of the third cuts 218 extends from the second end of the respective second cut 216 in the direction towards the center of the opening 210 in the longitudinal direction of the opening 210. Further, as is shown in FIG. 3, each of the third cuts 218 extends entirely along the edge of the opening 210. Thus, for each of the third cuts 218, the entire cut extends along the edge of the opening 210.

The four second cuts 216 and the four third cuts 218 are friction relieving cuts, relieving the friction generated when a sheet product is removed from the interior volume through the opening 210 in the top wall 202.

In particular, the third cuts 218 help to especially reliably avoid the problem that a portion of the sheet product to be removed from the interior volume may be caught by the cover member 212 at the second ends of the second cuts 216.

Therefore, the dispensing box according to the third embodiment allows for sheet products to be removed in a particularly quick and simple manner.

The cover member 212 further holds the next sheet product in a substantially upright position once a sheet product has been pulled completely through the opening 210. In this position, the sheet product extends out through the opening 210 and is thus readily accessible to the user.

Figure 4:
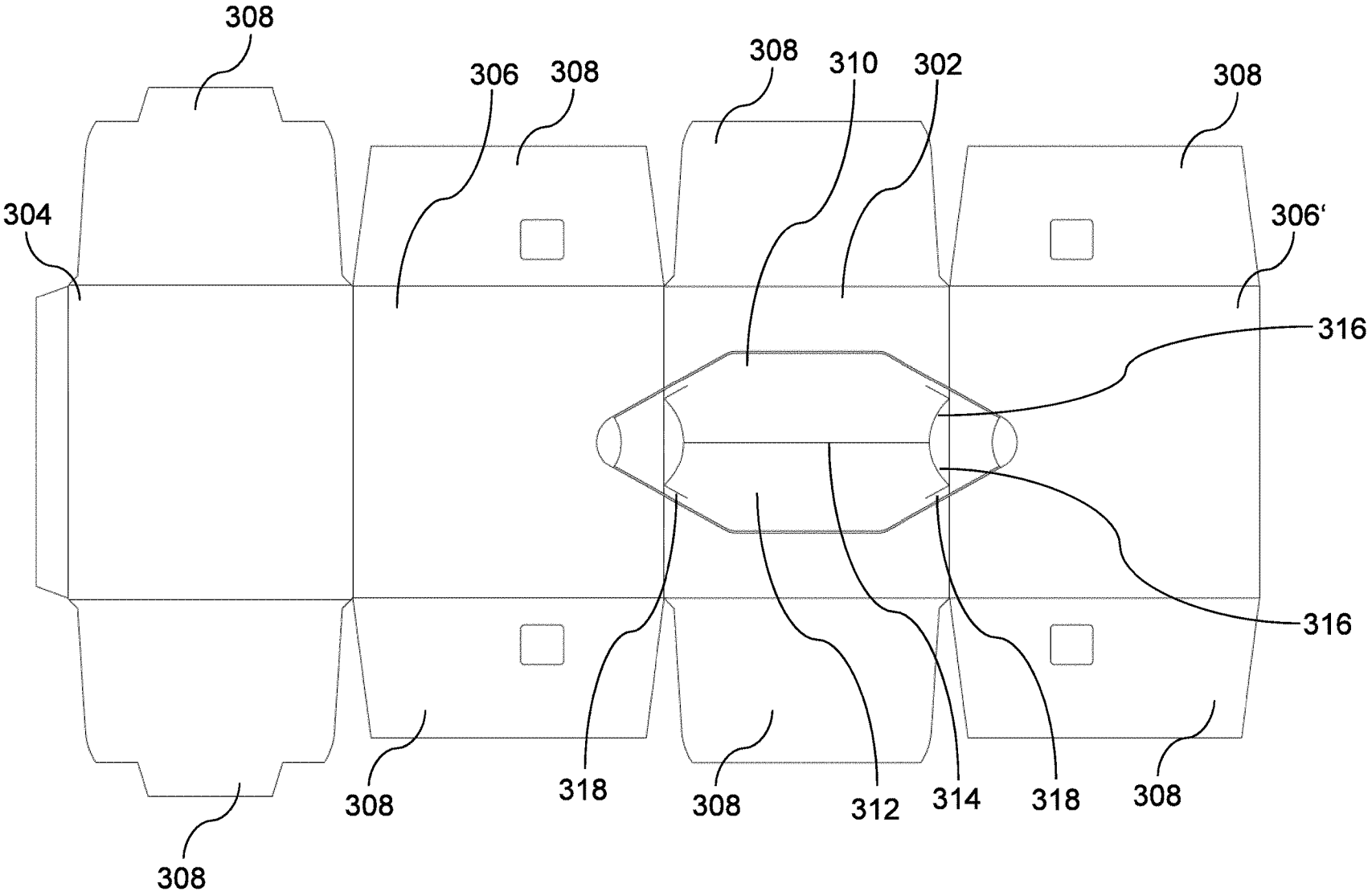
FIG. 4 shows a schematic top view of a dispensing box according to a fourth embodiment of the present disclosure in an unfolded state thereof.

FIG. 4 shows a schematic top view of a dispensing box according to a fourth embodiment of the present disclosure in an unfolded state thereof.

The dispensing box of the fourth embodiment differs from the dispensing box of the first embodiment only in the number, the shape and the arrangement of the cuts.

The arrangement of the plurality of walls and the shape of the folded, i.e., fully assembled, box of the fourth embodiment are the same as those of the first embodiment. Specifically, the box of the fourth embodiment has a substantially planar top wall 302, a substantially planar bottom wall 304, two opposing substantially planar side walls 306, 306' and eight end flaps 308 which form two opposing substantially planar end walls in the folded state of the box. In the folded state of the dispensing box, the box substantially has a cubic shape.

Also, the arrangement of the stack of sheet products (not shown) in the interior volume defined by the plurality of walls is the same for the boxes of the first and fourth embodiments.

An opening 310 for removing sheet products is provided in the top wall 302. The arrangement and the shape of the opening 310 are the same as those of the opening 10 of the dispensing box of the first embodiment. Specifically, as is shown in FIG. 4, the opening 310 is an elongate opening that extends to the side walls 306, 306' so as to be present also in the side walls 306, 306'. In the unfolded, i.e., laid out flat, state of the box, the opening 310 has the shape of an elongated hexagon with rounded corners at the ends thereof in the longitudinal direction. The maximum width of the opening 310 in the direction perpendicular to the longitudinal direction thereof is approximately half of the length of the opening 310 in the longitudinal direction thereof.

The dispensing box further comprises a cover member 312 which is provided so as to close the opening 310. The arrangement, the configuration, the material and the shape of the cover member 312 are the same as those of the cover member 12 of the dispensing box of the first embodiment. In particular, the cover member 312 is provided underneath the opening 310, i.e., underneath the opening 310 in the direction from the top wall 302 towards the bottom wall 304 in the folded state of the box. Alternatively, the cover member 312 may be provided above the opening 310. The cover member 312 is provided so as to extend beyond the opening 310 in all directions perpendicular to the direction from the top wall 302 towards the bottom wall 304.

The cover member 312 has a plurality of cuts, as will be detailed in the following. The shape and the arrangement of these cuts are similar to those of the cuts of the third embodiment.

Specifically, the cover member 312 has a first cut 314 extending along a first direction, i.e., the longitudinal direction of the opening 310. The first cut 314 has an extension in the first direction which is more than 70% of the extension of the stack of sheet products in the first direction. The first cut 314 has a straight shape and substantially extends along a center of the opening 310.

The first cut 314 may be provided in the cover member 312, for example, by using a cutting blade or the like. The first cut 314 may be provided in the cover member 312, for example, by using a cutting blade or the like, before or after the cover member 312 is secured to the remainder of the box.

Moreover, the cover member 312 has four second cuts 316, each second cut 316 extending from the first cut 314 along a respective second direction intersecting the first direction. In FIG. 4, only two of the four second cuts 316 are denoted with reference signs for better presentability.

The second cuts 316 may be provided in the cover member 312, for example, by using a cutting blade or the like. The second cuts 316 may be provided in the cover member 312, for example, by using a cutting blade or the like, before or after the cover member 312 is secured to the remainder of the box.

The configuration and the arrangement of the second cuts 316 are substantially the same as those of the second cuts 216 of the box according to the third embodiment.

In particular, two of the second cuts 316 extending from a first end of the first cut 314 extend in directions away from a second end of the first cut 314 towards opposite sides of the opening 310, and two of the second cuts 316 extending from the second end of the first cut 314 extend in directions away from the first end of the first cut 314 towards opposite sides of the opening 310. Further, the second cuts 316 each have a curved shape. As is shown in FIG. 4, for each of the second cuts 316, the center of curvature is at a position which is located outwards, i.e., towards the respective edge of the opening 310 or the respective edge of the top wall 302, from the end of the first cut 314 from which the respective second cut 316 extends.

Each second cut 316 has a first end, coinciding with the first end or the second end of the first cut 314, respectively, and a second end. The second direction is the direction from the first end of the respective second cut 316 towards the second end of the respective second cut 316. Each of the second directions of the second cuts 316 intersects the first direction at an angle of approximately 80° (see FIG. 4).

Each of the second cuts 316 extends to a position close to a respective edge of the opening 310. Specifically, each second cut 316 has an extension in the second direction which is approximately 90% of the distance between the position at which the respective second cut 316 extends from the first cut 314 and the edge of the opening 310 in the respective second direction.

Two of the second cuts 316 extend to a first side edge of the top wall 302 and two of the second cuts 316 extend to a second, opposite side edge of the top wall 302 (see FIG. 4).

The cover member 312 further has four third cuts 318, only two of which are denoted with reference signs in FIG. 4 for better presentability. Each third cut 318 has a straight shape and extends from the second end of a respective second cut 316. Each third cut 318 extends from the respective second cut 316 along a third direction intersecting the second direction (see FIG. 4). Each third cut 318 extends through the entire thickness of the cover member 312.

The third cuts 318 may be provided in the cover member 312, for example, by using a cutting blade or the like. The third cuts 318 may be provided in the cover member 312, for example, by using a cutting blade or the like, before or after the cover member 312 is secured to the remainder of the box.

Each of the third cuts 318 extends from the second end of the respective second cut 316 in the direction towards the center of the opening 310 in the longitudinal direction of the opening 310. Further, as is shown in FIG. 4, each of the third cuts 318 extends entirely along the edge of the opening 310. Thus, for each of the third cuts 318, the entire cut extends along the edge of the opening 310.

The four second cuts 316 and the four third cuts 318 are friction relieving cuts, relieving the friction generated when a sheet product is removed from the interior volume through the opening 310 in the top wall 302.

In particular, the third cuts 318 help to especially reliably avoid the problem that a portion of the sheet product to be removed from the interior volume may be caught by the cover member 312 at the second ends of the second cuts 316.

Therefore, the dispensing box according to the fourth embodiment allows for sheet products to be removed in a particularly quick and simple manner.

The cover member 312 further holds the next sheet product in a substantially upright position once a sheet product has been pulled completely through the opening 310. In this position, the sheet product extends out through the opening 310 and is thus readily accessible to the user.

Each of the disclosed openings can be used on each of the disclosed dispensing box shapes.

Thus, the present invention has been described by reference to the embodiments described above. It will be recognized that these embodiments are susceptible to various modifications and alternative forms well known to those of skill in the art without departing from the spirit and scope of the invention as defined by the appended claims.

What is claimed is:

1. A dispensing box, comprising:

a plurality of walls connected to each other and defining an interior volume, the plurality of walls including a top wall;

a stack of sheet products received in the interior volume;

an opening for removing sheet products provided at least in the top wall of the plurality of walls, wherein a width of the opening varies over a length of the opening, at least one side of the opening being contoured such that a width of the opening reduces from a central portion of the opening towards a side of the opening; and a cover member provided so as to at least partly close the opening, wherein the plurality of walls is made of a first material, the cover member is made of a second material, and the second material is more flexible than the first material, wherein the cover member has a first cut extending along a first direction, parallel to a length of the cover member, the first cut having a first end in the first direction and a second end in the first direction, wherein the first cut has an extension in the first direction which is at least 70% of an extension of the stack of sheet products in the first direction, and wherein the cover member further has a plurality of second cuts extending from the first cut along a second direction intersecting the first direction, wherein the plurality of second cuts including two second cuts, wherein the two second cuts extending from the first cut at a first position and a second position, respectively, wherein the first position and the second position being located between the first end and the second end of the first cut, wherein each of the plurality of second cuts is arranged at a position relative to the first cut where the opening has a maximum width, wherein the opening has a first portion having a constant width along the first direction, and a second portion extending from the first portion and reducing in width towards the sides of the opening, and wherein at least one of the second cuts is arranged at an intersection of the first portion and the second portion.

2. The dispensing box according to claim 1, wherein the second position is also located between the first end and the second end of the first cut.

3. The dispensing box according to claim 1, wherein the plurality of second cuts extend from the first cut towards opposite sides of the opening.

4. The dispensing box according to claim 1, wherein the plurality of second cuts extend from the first cut towards a same side of the opening.

5. The dispensing box according to claim 1, wherein the cover member has four second cuts.

6. The dispensing box according to claim 1, wherein at least one of the plurality of second cuts extends substantially to an edge of the opening.

7. The dispensing box according to claim 1, wherein the second direction is substantially perpendicular to the first direction.

8. The dispensing box according to claim 1, wherein the width of the opening in the direction perpendicular to the longitudinal direction of the opening is at least 30% of the length of the opening in the longitudinal direction of the opening.

9. The dispensing box according to claim 1, wherein the first cut has an extension in the first direction which is not more than 90% of an extension of the stack of sheet products in the first direction.

10. The dispensing box according to claim 1, wherein the plurality of walls has two opposing side walls which are connected to each other by the top wall, and the opening extends to the side walls so as to be present also in the side walls.

11. The dispensing box according to claim 1, wherein the plurality of walls substantially has a rectangular prism shape or a cubic shape.

12. The dispensing box according to claim 1, wherein adjacent sheet products in the stack of sheet products are interfolded with each other.

13. The dispensing box according to claim 1, wherein the first cut has a straight shape, a curved shape or an undulating shape.

14. The dispensing box according to claim 1, wherein the at least one second cut has a straight shape, a curved shape or an undulating shape.

15. The dispensing box according to claim 1, wherein the first cut substantially extends along a center of the opening.

16. The dispensing box according to claim 1, wherein the plurality of walls is made of cardboard.

17. The dispensing box according to claim 1, wherein the cover member is made of a plastic material.

18. The dispensing box according to claim 1, wherein the stack of sheet products is received in the interior volume in a substantially uncompressed state.

19. The dispensing box according to claim 1, wherein the cover member has a thickness in the range of 60 μm to 80 μm.

20. The dispensing box according to claim 1, wherein the first cut extends to the side walls so as to be formed in the side walls, and each of the plurality of second cuts is formed in the top wall.

21. A dispensing box, comprising:

a plurality of walls connected to each other and defining an interior volume;

a stack of sheet products received in the interior volume;

an opening for removing sheet products provided at least in a top wall of the plurality of walls; and a cover member provided so as to at least partly close the opening, wherein the plurality of walls is made of a first material, the cover member is made of a second material, and the second material is more flexible than the first material, the cover member has a first cut extending along a first direction, the cover member further has at least one second cut extending from the first cut along a second direction intersecting the first direction; and the cover member further has at least one third cut extending from the at least one second cut in a third direction arranged to intersect both the first direction and the second direction, the at least one third cut being oriented parallel to and offset from an adjacent surface of the opening and extending towards a center of the opening in a longitudinal direction of the opening, wherein the at least one third cut extends from the at least one second cut at a position spaced away from the first cut.

* * * * *